United States Patent [19]

Singelyn et al.

[11] Patent Number: 4,654,089

[45] Date of Patent: Mar. 31, 1987

[54] COUNTERFLOW SPRAY RINSE PROCESS

[76] Inventors: Daniel D. Singelyn; Paul J. Singelyn, both c/o Techmatic, Inc., 133 Lyle La., Nashville, Tenn. 37210

[21] Appl. No.: 740,005

[22] Filed: May 31, 1985

[51] Int. Cl.[4] ..... B08B 30/00; B08B 7/04

[52] U.S. Cl. ..... 134/26; 134/10; 134/27; 134/28; 134/29

[58] Field of Search ..... 134/10, 26, 27, 28, 134/29

[56] References Cited

U.S. PATENT DOCUMENTS

| | | | |
|---|---|---|---|
| 3,734,108 | 5/1973 | Almegard et al. | 134/76 |
| 3,849,197 | 11/1974 | Sorrentino | 134/18 X |
| 3,888,693 | 6/1975 | Schevey et al. | 134/26 X |
| 4,017,343 | 4/1977 | Hoos | 134/10 X |
| 4,379,031 | 4/1983 | Krotkiewicz et al. | 134/26 X |
| 4,432,846 | 2/1984 | Honeycutt, III | 134/28 X |
| 4,452,264 | 6/1984 | Kreisel et al. | 134/58 R |
| 4,498,934 | 2/1985 | Potts | 134/10 X |
| 4,572,746 | 2/1986 | Wegner | 134/26 X |

OTHER PUBLICATIONS

"Low Cost Recovery", Paper Presented at AES National Convention, in Phila Pa., Jun. 1986, Dan and Paul Singelyn Techmatic Inc.

Techmatic Inc., Maxevap TM, Atmospheric Evaporator and Pulse Spray Counterflow Rinsing.

*Primary Examiner*—Andrew H. Metz
*Assistant Examiner*—William G. Wright
*Attorney, Agent, or Firm*—Harrington A. Lackey

[57] ABSTRACT

A process and an apparatus for rinsing a chemically treated or plated article by sequentially moving the article initially over a chemical solution bath and subsequently over a plurality of rinse baths, in which the article is sprayed as it rises from each successive bath with a less concentrated rinse solution from the next succeeding bath.

6 Claims, 3 Drawing Figures

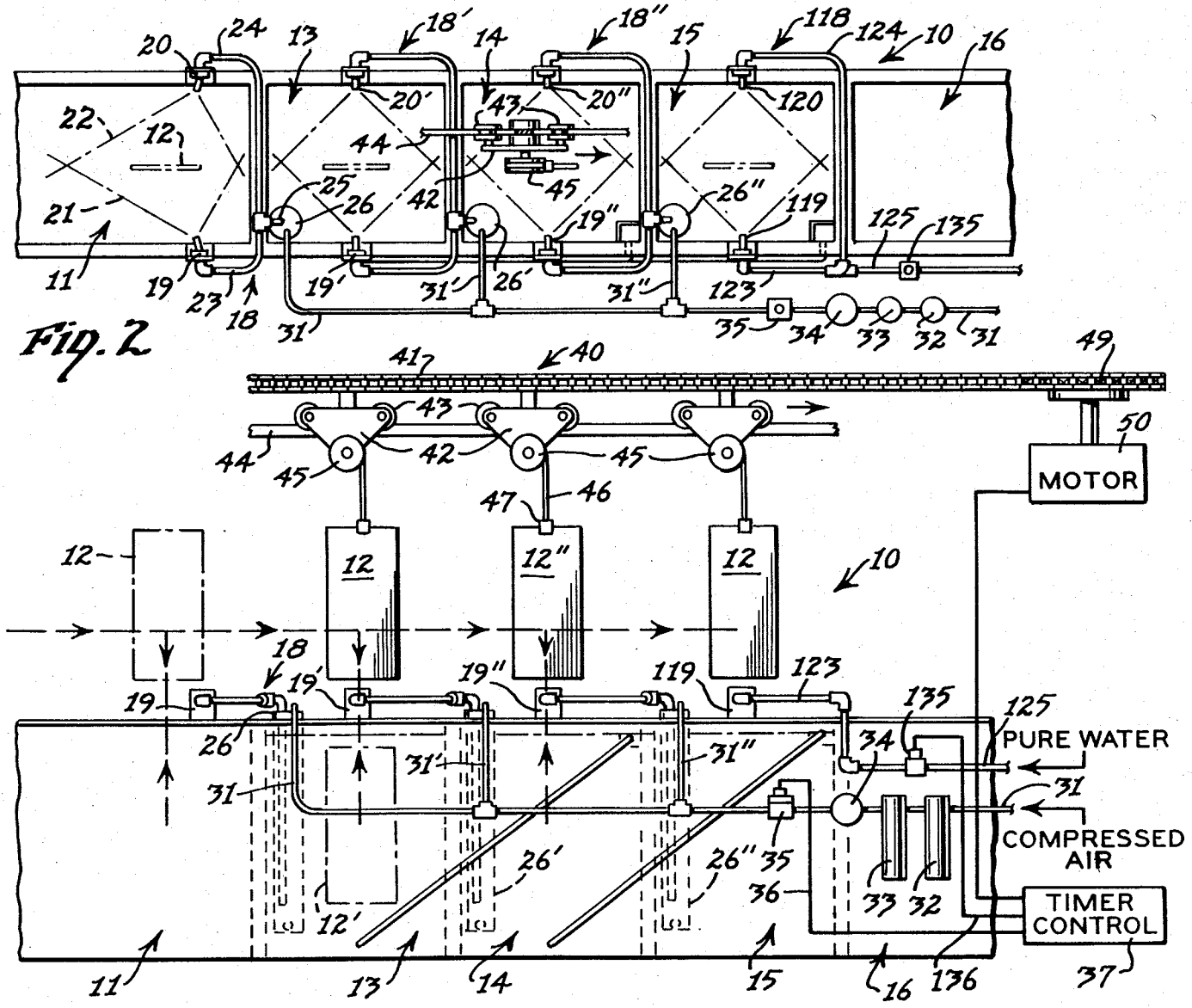
Fig. 2
Fig. 1
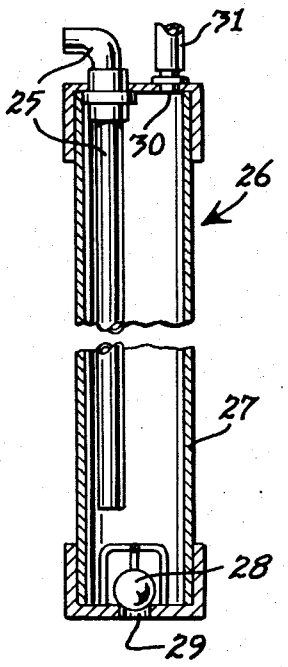
Fig. 3

COUNTERFLOW SPRAY RINSE PROCESS

BACKGROUND OF THE INVENTION

This invention relates to the rinsing of surface-treated articles, and more particularly to a counterflow spray rinse process for surface-treated articles.

Articles, whose surfaces have been chemically or electrochemically treated, such as by electroplating or galvanizing, require rinsing in order to remove the residue or adhering substances from the articles, before further processing.

It is known in the art to utilize a plurality of rinse tanks filled with water so that the chemically treated article is rinsed in stages to gradually remove the concentrated solution or residue. In such a process, the first rinse tank gradually becomes more concentrated than each subsequent rinsing tank, because more residue is removed from the article in the first rinse tank than in any subsequent rinse tank. Eventually, the rinse tank has to be drained and refilled with substantially pure water. Moreover, as the original processing bath continues to receive and treat the article with the concentrated solution, the original processing solution becomes diluted, and the chemicals have to be replenished and the excess water removed, usually by draining. Sometimes the water is removed by evaporation.

It is also known in the the art to re-cycle the rinse water by processing it in an ion-exchange installation in order to detoxify the water. However, such recovery processes are expensive.

Other methods of rinsing articles whose surfaces have been treated with chemical or elector-chemical processes are shown in the following U.S. Pat. Nos:

3,734,108—Almegard et al—May 22, 1973

4,452,264—Kreisel et al—June 5, 1984

Both the Almegard and Kreisel patents disclose as prior art, a counterflow process, in which water flows in a cascade arrangement serially from one rinse tank to another in the direction opposite the movement of the treated article, so that the water in the rinse tank closer to the treatment tank becomes progressively enriched with the residual substance. When numerous rinse tanks are employed in the counterflow cascade process, pumps must be utilized in order to pump the water from one tank to the next. In such a cascade process, although conserving fresh water, the pumping of such large volumes of water becomes expensive.

Both the Almegard and Kreisel patents also disclose that it is old to spray-rinse an article whose surface has been chemically or electro-chemically treated. However, the spray processes disclosed in both Almegard and Kreisel utilize a single spraying chamber, and in some instances, the spray chamber is made mobile so that it can be utilized to spray-rinse articles at several different treatment tanks.

However, neither Amegard nor Kreisel, nor any other prior art known to the applicant, discloses a rinse process incorporating a pulse spray counterflow principle which is most applicable for rinsing chemically or electro-chemically treated articles, such as copper-, nickel-, zinc-, or chrome-plated articles.

Submersible pumps having a pump chamber with an inlet check valve for receiving a fluid in which the pump chamber is submerged, and also provided with a compressed air inlet for receiving compressed air to discharge the fluid from the pumps, are well known in the art, as shown in the following U.S. Pat. Nos:

129,353—Lytle—July 16, 1872

1,072,562—DeLissaBerg—Sept. 9, 1913

2,171,402—Muir—Aug. 29, 1939

3,552,884—Faldi—Jan. 5, 1971

However, none of the above patents disclose the above submersible pumps used in combination with a counterflow spray rinse process for surface treated articles.

SUMMARY OF THE INVENTION

It is therefore an object of this invention to provide a counterflow spray rinse process and apparatus for surface-treated articles, such as chemically plated articles, by establishing a plurality of sequential rinse tanks or baths, and spraying the article over each bath with a rinse solution of lesser concentration from the next succeeding bath.

In the process carried out in accordance with this invention, the spray apparatus is set up over each of the rinse tanks and optionally over the original chemical treatment or processing tank, and each sprayer is connected to a pump in fluid communication with the next succeeding bath having a more dilute rinse solution.

Also, in accordance with this process, the surface-treated article to be rinsed, is moved from the chemical process tank or bath to a position over a first rinse tank, where it is lowered and immersed in the first rinse bath for a predetermined time. The article is then lifted from the first rinse bath and simultaneously sprayed with the dilute solution from the next or second rinse bath. The article is then transported to a position over the second tank where the article is lowered and immersed in the second rinse bath. The article is subsequently sprayed, as it rises from the second bath, with a more dilute solution from the third rinse bath. This process is continued until the article is finally rinsed with substantially pure water.

The number of rinse baths or tanks and spray apparatus may vary, depending upon the concentration of the original processing solution and the degree of rinsing required.

In a preferred form of the apparatus utilized in the rinsing process in accordance with this invention, submersible pumps are preferably used in each of the rinse baths. A spray apparatus is located on the top of each bath with spray heads directed toward each other to spray both sides of an article in spraying position over the corresponding bath. Each spray apparatus is connected to a pump submerged in the next succeeding bath. The pumps are preferably powered by compressed air.

A transfer mechanism is utilized for transporting the articles from one bath to the next bath and for raising and lowering the article into and out of immersion in the corresponding bath.

The transfer mechanism and the spray apparatus are timed by appropriate timer controls so that the spray apparatus is actuated only as the article is lifted from its corresponding bath.

With a process utilized in accordance with this invention, pure water is applied to the article only by the final spray apparatus.

While the article to be rinsed sequentially encounters less concentrated rinsing solutions, the rinsing solutions are counterflowing in the opposite direction from the movement of the article. Thus, while each bath is receiving a more dilute solution from the discharging spray apparatus, the same bath is also receiving more concentrated solutions from the material removed from the immersed plate or article. Thus, when the spray heads discharge a rinse solution over the original processing bath, the processing bath is being replenished by some of the chemicals which it originally possessed. Accordingly, the supply of other replenishment chemicals may be reduced from the requirements of conventional surface treatment processes. Moreover, since the chemicals are being recycled, they need not be treated as waste products.

Furthermore, substantially reduced quantities of pure water are required for the entire rinsing process.

BRIEF DESCRIPTION OF THE DRAWINGS

FIG. 1 is a fragmentary side elevation of an apparatus, shown schematically, for carrying out the counterflow rinse process in accordance with this invention;

FIG. 2 is a fragmentary top plan view of the apparatus disclosed in FIG. 1, with only a portion of the overhead conveyor disclosed, and illustrating the spray patterns over the respective baths; and FIG. 3 is an enlarged sectional elevation of a submersible pump used in the counterflow spray system for carrying out this invention, with portions broken away.

DESCRIPTION OF THE PREFERRED EMBODIMENTS

Referring now to the drawings in more detail, FIGS. 1 and 2 disclose an apparatus 10 carrying out the counterflow spray rinse process in accordance with this invention. The apparatus 10 includes a surface treating tank, such as a metal plating tank or bath 11 filled with a chemical solution for treating an article, such as the metal plate 12.

Located in succession or series with the chemical processing tank 11 are a first rinse tank 13, a second rinse tank 14, a third rinse tank 15, and a subsequent process or treating tank 16. It will be understood that more or fewer rinse tanks may be employed, depending upon the requirements of the rinsing process. Each of the rinse tanks 13, 14, and 15 is originally filled with pure water. The chemical treatment bath or tank 11 is originally filled with the desired chemical solution at the desired concentration for the proper treatment, such as metal plating, of the article 12.

Mounted on top of the treatment tank 11, is a spray apparatus 18, including a pair of opposed spray heads 19 and 20. Each spray head 20 is directed toward an opposite side of the article 12, when the article 12 is in an elevated spray position above the tank 11 as disclosed in phantom in FIG. 1. The attitude of each spray head 19 and 20, as well as the width of its particular spray path, is such that each spray head 19 and 20 will discharge its solution in the spray patterns 21 and 22, illustrated in FIG. 2, to completely cover both sides of the article 12.

The spray heads 19 and 20 are connected by the respective branch fluid conduits 23 and 24 to a discharge conduit 25 from a submersible pump 26, submerged in the rinse bath of the first rinse tank 13, as illustrated in FIGS. 1 and 2. As best disclosed in FIG. 3, the discharge conduit 25 extends downward, almost to the bottom of the pump housing 27. The pump housing 27 includes a check valve, such as a diaphragm or a ball check valve 28, adapted to open and close a rinse solution inlet port 29. In the top of the pump housing 27 is an air inlet port 30 in fluid communication with an air supply conduit 31, which is supplied with compressed air from a source, not shown, but indicated in FIG. 1.

As best disclosed in FIGS. 1 and 2, the air line or conduit 31 preferably includes a pair of air filters 32 and 33, a pressure regulator 34, and a timer control solenoid valve 35. The solenoid valve 35 may be connected through the electrical line 36 to a timer control 37 of any conventional design, or to the transfer mechanism controls, not shown.

In the operation of the spray heads 19 and 20, when the solenoid valve 35 is open to admit the passage of compressed air, the compressed air enters the top of the pump housing 27, through the inlet 30, to force the check valve 28 to a closed position over the liquid inlet 29. The air forces the rinse solution contained within the housing 27 up through the discharge conduit 25, the branch conduits 23 and 24, and out through the spray heads 19 and 20 upon the opposite sides of the plate 12 as the plate 12 rises between the spray heads 19 and 20 over the treatment tank 11.

It will be noted, particularly in FIGS. 1 and 2, that the fluid discharged through the spray heads 19 and 20 is derived from the contents of the first rinse tank 13. Thus, since the liquid solution in the first rinse tank 13 is of lesser concentration than the checmical solution in the treatment tank 11, a dilute spray solution will be sprayed upon both sides of the plate 12 over the tank 11, as the plate 12 is lifted from immersion in the solution of the tank 11, to increase the rinsing efficiency. After the rinse solution impinges upon the surfaces of the article 12, it falls into the more concentrated chemical solution of the tank 11, thereby diluting the original chemical solution to some degree.

In a somewhat similar arrangement, a spray apparatus 18′ with spray heads 19′ and 20′ is mounted on top of the first rinse tank 13, while its supply pump 26′ is immersed in the next succeeding rinse tank 14, as disclosed in FIGS. 1 and 2. Like parts are identified with prime reference numerals.

Also, a similar spray apparatus 18″ with spray heads 19″ and 20″ are mounted on top of the second rinse tank 14 with their supply pump 26″ immersed in the rinse solution of the third rinse tank 15. In a similar manner, like parts are identified by double-prime reference numerals.

Each of the pumps 26′ and 26″ is supplied with compressed air through the air branch lines 31′ and 31″, respectively, each of which is connected to the main air supply line 31.

As disclosed in the drawings, another rinse spray apparatus 118 having spray heads 119 and 120 is mounted upon the third rinse tank 15 with the branch conduits 123 and 124, connected to a pure water supply line 125, which in turn is connected to a source of pure water, not shown. In order to control the flow of water through the water line 125 to the spray apparatus 118, a solenoid fluid valve 135 is mounted in the line and connected through electrical line 136 to the timer control 137, or to the transfer mechanism controls, not shown.

Thus, each of the spray apparatus 18′ and 18″ spray a rinse solution upon a plate or article 12 as the article rises through a spraying position over the particular rinse tank upon which the spray heads are mounted. However, the corresponding rinse solution is of lesser concentration than the concentration of the bath over which the article 12 is sprayed, because the rinse solution is supplied through a corresponding pump 26′ or 26″ in the next succeeding rinse tank.

On the other hand, the spray apparatus 118 sprays pure water upon the plate 12 as the plate rises from immersion in the tank 15. Thus, a rinse solution sprayed by the spray apparatus 118 is also of lesser or weaker concentration than the solution within the tank 15.

Because of the differences in the number of times the plate 12 is immersed as it advances from one successive rinse tank to the next, the concentration of each rinse solution is at any time, greater than the rinse solution in the next successive rinse tank.

The article or plate 12 may be advanced from the chemical processing or treatment tank 11 to each successive rinsing stage 13, 14, and 15 by any convenient type of transfer machanism, such as the overhead conveyor mechanism 40. The overhead cohveyor 40 may include an endless conveyor chain 41 from which are suspended a plurality of trolleys 42 having wheels 43 guided on an overhead rail 44. Each of the trolleys or brackets 42 may carry a small electrical motorand windlass 45 about which is wound a flexible cable 46. The lower end of each cable 46 is provided with a connector or clamp 47 for gripping a corresponding article or plate 12 as the plate 12 is being transported from one tank to another.

The chain or cable 41 may be moved by a sprocket or pulley 49 driven by the motor 50.

In carrving out the process according to this invention with the apparatus 10, a plate 12 is secured by a clamp 47 to one of the cables 46 of a windlass 45. The motor 50 is energized to drive the chain forward in the direction of the arrows disclosed in FIGS. 1 and 2. The plate 12 is moved by the trolleys 42 in an elevated position above the tanks 11–16.

When the plate 12 arrives at the desired position over the chemical plating or processing tank 11, the timer control 37 is actuated to stop the motor 50 and energize the windlass 45 to lower the plate 12 in the direction of the arrow, so that the plate 12 is immersed in the tank 11. The windlass motor 45 is then stopped for a predetermined time while the plate 12 is plated or treated while immersed in the tank 11. At the end of the predetermined time, the timer control 37 reverses the windlass motor 45 to lift the plate 12 to its original transport position as disclosed in FIG. 1. As the plate 12 rises above the liquid level of the bath 11, the timer control energizes both solenoid valves 35 and 135 to commence operation of the spray apparatus 18 and thereby spray both sides of the article 12 as it moves upward between the spray heads 19 and 20, as illustrated in FIGS. 1 and 2. When the plate 12 is elevated to the position disclosed in phantom in FIG. 1, the timer control 37 stops the actuation of the windlass 45 and the spray solenoids 35 and 135, and re-energizes the motor 50 to move the article 12 from its dashed-line position over the tank 11 to the solid-line position, illustrated in FIG. 1, over the first rinse tank 13.

The timer control 37 then stops the motor 50 and re-actuates the windlass 45 to lower the plate 12 into the tank 13 until it 13 reaches its phantom position 12' (FIG. 1) The plate 12 remains in its position 12' for a predetermined time while it soaks in the solution of the rinse tank 13. At the end of this time, the timer controls 37 reactuate the windlass 45 to reverse the winding of the cable 46. Again, as the plate 12 rises out of the first rinse bath 13, the solenoids 35 and 135 are re-opened to actuate the sprayer apparatus 18' so that both sides of the plate or article 12 are sprayed with rinse solution from the tank 14, which is of lesser concentration than that in the rinse solution of the tank 13. When the plate 12 is lifted to its transport position disclosed in solid lines in FIG. 1, the windlass 45 is stopped, the solenoid valves 35 and 135 closed, and the motor 50 re-energized to move the article to the position 12" over the second rinse tank 14, as disclosed in FIG. 1.

The timer operation is repeated. The motor 50 is stopped and the windlass 45 lowers the plate 12 into immersion in the tank 14. The plate 12 remains immersed for a predetermined time and is then lifted to its original transport position over the tank 14. During the lifting phase, the spray apparatus 18" is actuated to spray both sides of the plate 12".

This cycling of the timer control 37 and the operation of the motor 50 and the windlass 45 is continued until the plate 12 is elevated past the actuated sprayer apparatus 118 spraying both sides of the plate 12 with pure water. If desired, the conveyor apparatus 40 carries the water rinsed plate 12 from its position over the tank 15 to its position over the next processing tank 16 where the plate is lowered for a subsequent chemical treatment.

Instead of the timer control 37, limit switches, not shown, could be employed to actuate each sprayer apparatus during the article-lifting cycle, if desired.

As disclosed in FIG. 1, although the sequence of operations for a single plate 12 has been described, nevertheless, as disclosed in FIG. 1, a plurality of plates may be carried by the longitudinally spaced trolleys 42, and all of the plates 12 will be transported, stopped, lowered, soaked, and lifted through a spraying phase, simultaneously. Thus, plates will be raised and lowered simultaneously into every one of the tanks 11–15 as the cycle continues.

By utilizing the counterflow system of the progressive rinse tanks 13–15, and producing the counterflow by sequential pulse sprayer apparatus, substantial efficiency in rinsing is attained, and very little fresh pure water is required.

In actual operations to attain the same degree of rinsing for an apparatus 10 including only the process tank 11, one intermediate tank 13, and one final tank 15, with only two spray apparatus 18 and 118, it has been found that only 3 gallons of fresh water is required to replenish the rinse system for each 100 square feet of article surface rinsed.

For the same 100 square feet of article surface rinsed, 500 gallons of fresh water would be required for a single rinse tank 15, succeeding the processing tank 11, and without use of any sprays or counterflow.

If two rinse tanks 13 and 15 were employed with a process tank 11, with no counterflow of water and with no sprays, 30.6 gallons of water would be needed to feed both rinse tanks 13 and 15.

In a system in which the process tank 11 is utilized with rinse tanks 13 and 15 only, the water from the rinse tank 15 is counterflowed, such as by cascading to the rinse tank 13, 15.6 gallons of fresh water would be required to replenish the rinse system in order to rinse 100 square feet of the surface of an article 12.

The above volume comparisons of the requirements for fresh rinse water are applicable to the same flat plate article which was rinsed by all of the described processes.

It will be understood that the volume of rinse water will vary, depending upon the type of work being spray-rinsed. For example, wire goods would require little fresh water replenishment, while tubular goods would require more rinse water.

In a typical system, each cycle requires about 36 seconds. Six seconds are required to lower an article 12 from its overhead transport position into immersion within the tank. The article remains immersed within the tank for a dwell period of approximately 18 seconds. The lift cycle for elevating the plate from its immersed position within the tank to its elevated transport position, is about 6 seconds. Only during the lift cycle is the article sprayed. Then the article requires 6 seconds for transport from its position over one tank to the transport position over the next adjacent tank, for a total of 36 seconds.

It will thus be seen, that an apparatus 10 and process for a counterflow rinse system in which the rinsed article is pulse-sprayed for a brief period of time as it is lifted from the tank in which it is immersed, is a highly efficient system for thoroughly rinsing the article and also for the conservation of water.

It has been found that this counterflow spray-rinse process utilized even with only two rinse tanks, can save substantial volumes of water as well as eliminating all of the undesirable residual chemicals from the surfaces of the articles, to pemit the article to be further processed or utilized without any deleterious contaminants.

It has also been found, that, in many cases, the volume of rinse water is small enough to be added to the process or treating tank 11 in its entirety to replace evaporative losses. Such procedure has the advantage of saving the dragged-out chemicals, as well as avoiding a pollution problem.

What is claimed is:

1. A process for rinsing an article treated with a solution of initial concentration, comprising the steps of:

(a) immersing an article in a chemical solution of initial concentration within a first bath, (b) raising said article from said first bath to a first spraying position vertically above said first bath, (c) spraying said article in said first spraying position with a first rinse solution from a second bath downstream of said first bath, said first rinse solution being of lesser concentration than said chemical solution, the sprayed first rinse solution, not adhering to said article, falling into said first bath, (d) transferring said article from said first spraying position to a position over said second bath, (e) lowering said article into said second bath to immerse said article in said first rinse solution, (f) raising said article from said second bath to a second spraying position vertically above said second bath, (g) spraying said article in said second spraying position with a second rinse solution of lesser concentration than said first rinse solution, a third bath downstream of said second bath, said the sprayed second rinse solution, not adhering to said article, falling into said second bath.

2. The process according to claim 1 further comprising a series of rinse baths, including said second bath, downstream of said first bath, each of said rinse baths in said series containing a rinse solution of lesser concentration than the rinse solution in the next upstream bath, and further comprising the steps of spraying said article vertically above each of said baths with a rinse solution from said next downstream bath.

3. The process according to claim 2 in which said chemical solution in said first bath comprises predetermined chemicals, the rinse solutions in the series of rinse baths comprising said chemicals in lesser concentration in succeeding downstream baths.

4. The process according to claim 3 in which said series of baths comprises a final bath, said rinse solution in said final bath being substantially pure water.

5. The process according to claim 2 further comprising the step of pumping each rinse solution from its corresponding bath to a spray apparatus in said next upstream spraying position.

6. The process according to claim 2 further comprising the step of holding said article for a predetermined time in each successive bath, while it is being immersed and before it is raised to said corresponding spraying position.

* * * * *

UNITED STATES PATENT AND TRADEMARK OFFICE

CERTIFICATE OF CORRECTION

PATENT NO. : 4,654,089

DATED : Mar. 31, 1987

INVENTOR(S) : Daniel D. Singelyn, et al.

It is certified that error appears in the above-identified patent and that said Letters Patent is hereby corrected as shown below:

Col. 8, line 13, cancel "a third bath".

Col. 8, line 14, cancel "downstream of said second bath, said".

Signed and Sealed this

Twenty-eighth Day of November 1989

*Attest:*

JEFFREY M. SAMUELS

*Attesting Officer* *Acting Commissioner of Patents and Trademarks*